US006198374B1

(12) United States Patent
Abel

(10) Patent No.: US 6,198,374 B1
(45) Date of Patent: Mar. 6, 2001

(54) MULTI-LAYER TRANSFORMER APPARATUS AND METHOD

(75) Inventor: David A. Abel, Watertown, SD (US)

(73) Assignee: Midcom, Inc., Watertown, SD (US)

( * ) Notice: Subject to any disclaimer, the term of this patent is extended or adjusted under 35 U.S.C. 154(b) by 0 days.

(21) Appl. No.: 09/283,713

(22) Filed: Apr. 1, 1999

(51) Int. Cl.[7] ..... H01F 5/00
(52) U.S. Cl. ..... 336/200; 336/223; 336/232
(58) Field of Search ..... 336/200, 223, 336/232

(56) References Cited

U.S. PATENT DOCUMENTS

| | | | |
|---|---|---|---|
| 3,765,082 | 10/1973 | Zyetz . | |
| 3,833,872 | 9/1974 | Marcus et al. . | |
| 3,947,934 | 4/1976 | Olson . | |
| 4,547,961 | 10/1985 | Bokil et al. . | |
| 4,785,345 | 11/1988 | Rawls et al. . | |
| 4,942,373 | 7/1990 | Ozawa et al. . | |
| 5,126,714 | 6/1992 | Johnson . | |
| 5,184,103 | 2/1993 | Gadreau et al. . | |
| 5,225,969 | 7/1993 | Takaya et al. . | |
| 5,312,674 | 5/1994 | Haertling et al. . | |
| 5,349,743 | 9/1994 | Grader et al. . | |
| 5,430,424 | 7/1995 | Sato et al. | 336/200 |
| 5,471,721 | 12/1995 | Haertling . | |
| 5,479,695 | 1/1996 | Grader et al. . | |
| 5,515,022 | 5/1996 | Tashiro et al. . | |
| 5,521,573 | 5/1996 | Inoh et al. . | |
| 5,532,667 | 7/1996 | Haertling et al. . | |
| 5,551,146 | 9/1996 | Kawabata et al. . | |
| 5,583,474 | 12/1996 | Mizoguchi et al. . | |
| 5,589,725 | 12/1996 | Haertling . | |
| 5,598,135 | 1/1997 | Maeda et al. . | |
| 5,716,713 | 2/1998 | Zsamboky et al. . | |
| 5,821,846 | 10/1998 | Leigh et al. . | |

FOREIGN PATENT DOCUMENTS

| | | | |
|---|---|---|---|
| 24 09 881 A1 | 8/1974 | (DE) | 336/200 |
| 0 530 125 A2 | 3/1993 | (EP) . | |
| 2 476 898 | 8/1981 | (FR) . | |
| 2 163 603A | 2/1986 | (GB) . | |
| 59-52811 | 3/1984 | (JP) . | |
| 6-224043 | 8/1994 | (JP) . | |
| 8-130116 | 5/1996 | (JP) . | |

*Primary Examiner*—Lincoln Donovan
*Assistant Examiner*—Anh Mai
(74) *Attorney, Agent, or Firm*—Merchant & Gould P.C.

(57) ABSTRACT

A multi-layer transformer includes a plurality of tapes having a magnetic core area disposed on at least one of the layers forming a magnetic core of the transformer. A primary winding is disposed on at least one of the layers. A secondary winding is disposed on at least one of the layers. A thin layer made of a lower permeability dielectric material is disposed proximate at least one of the windings. A first plurality of interconnecting vias connect the primary winding between the tapes. A second plurality of interconnecting vias connect the secondary winding between the tapes. Magnetic flux is induced to primarily flow into the core area. Magnetic coupling and dielectric breakdown between the windings are improved. A lower cost and smaller sized transformer can be obtained.

23 Claims, 5 Drawing Sheets

MULTI-LAYER TRANSFORMER APPARATUS AND METHOD

BACKGROUND OF THE INVENTION

1. Field of the Invention

This invention relates to multi-layer transformers, more specifically, to multi-layer transformers with improved magnetic coupling and dielectric breakdown voltage between windings in the multi-layer transformers.

2. Description of Related Art

The use of multi-layer transformers is widely known. In general, a multi-layer transformer is constructed with the following process. A magnetic material, for example, ferrite, is cast into tape. The tape is then cut into sheets or layers, and vias are formed at the required locations in each of the tape layers to form conductive pathways. Conductive pastes are subsequently deposited on the surface of the tape layers to form the spiral windings which terminate at the vias. After that, a number of the tape layers with corresponding conductive windings are stacked up with vias in appropriate alignment to form a multi-turn transformer structure. The collated layers are joined together by heat and pressure. The structure is then transferred to a sintering oven to form a homogenous monolithic ferrite transformer. With the above process, many transformers can be made at the same time by forming an array of vias and conductive windings on the surface of the ferrite layers. The transformer may be singulated pre or post firing. FIGS. 1–2 show an example of a traditional ferrite transformer formed by using the above process.

However, a transformer constructed in the above process has a uniform magnetic permeability throughout the multi-layer structure. Some of the magnetic flux lines generated by the conductive windings cut through the adjacent windings. For example, in a structure where primary windings and secondary windings are disposed in an interleaving relationship on different layers, not all flux lines generated by the primary windings cut through the secondary winding. This yields inefficient flux linkage between the primary windings and the secondary windings. The efficiency of the flux linkage between primary windings and secondary windings can be determined by a magnetic coupling factor. Generally, the magnetic coupling factor between primary and secondary windings is defined as $\alpha=$ $$\sqrt{\frac{L_{pri}-L_{leak}}{L_{pri}}},$$

wherein $L_{pri}$ represents primary magnetizing inductance, and $L_{leak}$ represents the inductance measured across the primary winding with the secondary winding shorted. It has been determined empirically that coupling is a function of proximity between windings. A transformer (as shown in FIGS. 1 and 2) with a uniform permeability has a magnetic coupling factor of 0.83.

Though a closer spacing between the windings in adjacent layers can obtain a higher magnetic coupling factor, the ferrite layers must be made thick enough to withstand a minimum voltage where no dielectric breakdown occurs between the windings. For example, the thickness of a typical NiZn ferrite material requires more than 7 mils to withstand 2400 VAC.

In order to obtain a high magnetic coupling factor, another method has been suggested in U.S. Pat. No. 5,349,743. The '743 patent suggests forming apertures and sing two separate materials to limit the magnetic flux paths to a well defined core area to increase coupling. However, this method is very expensive and limits transformer miniaturization due to the need to make apertures and fill them with a different material than the tape.

Thus, there is a need in the art for an improved multi-layer transformer with a higher magnetic coupling between the windings. Also, there is a need for such an improved multi-layer transformer to be constructed in a lower cost and smaller size, and/or to be readily mass producable in an automated fashion, as well as to meet regulatory safety requirements.

SUMMARY OF THE INVENTION

To overcome the limitations in the art described above, and to overcome other limitations that will become apparent upon reading and understanding the present specification, the present invention provides a method and apparatus of providing a multi-layer transformer with an improved magnetic coupling without affecting its electrical isolation characteristics.

The present invention provides a layer of low permeability dielectric material, thinner than but mechanically and chemically compatible with the higher permeability tape. The thin layer can be disposed on top of, on bottom of, or in between the conductive windings. It is understood that the thin layer may be screen-printed or pasted onto the tapes. The thin layers create areas of different permeability within the structure. The dielectric material in the thin layer also chemically interacts with the ferrite tape during sintering to selectively lower the ferrite permeability in the screened areas. The low permeability dielectric material forms high reluctance paths for the magnetic flux between the windings, thus encouraging the magnetic flux formation in the desired magnetic core volume rather than taking short cuts between windings. Thus, more flux linkages are formed between all primary and secondary windings thereby significantly improving the magnetic coupling factor.

In one embodiment of the present invention, a transformer having a multi-layer tape structure comprises a plurality of tapes being stacked one over the other having a magnetic core area proximate a center of the tapes of the transformer, a primary winding disposed on at least one of the tapes, a secondary winding disposed on at least one of the tapes, a first plurality of interconnecting vias connecting the primary winding between the tapes, a second plurality of interconnecting vias connecting the secondary winding between the tapes, and a layer being disposed proximate at least one of the primary and secondary windings between the tapes, wherein the layer is made of a lower permeability dielectric material in comparison to that of the tapes to form high reluctance paths for magnetic flux between the windings such that the magnetic flux flow is maximized in the magnetic core area.

Further in one embodiment of the present invention, the primary winding and the secondary winding may be disposed in an interleaved relationship on the tapes.

Still in one embodiment of the present invention, the primary winding and the secondary winding may be disposed on adjacent tapes.

Still in one embodiment of the present invention, the primary winding and the secondary winding may be disposed on the same tape.

Yet in one embodiment of the present invention, the layer is mechanically and chemically compatible with the tapes.

Further in one embodiment of the present invention, the layer is screen-printed onto the primary and secondary windings.

Further in one embodiment of the present invention, the layer is pasted onto the primary and secondary windings.

Still in one embodiment of the present invention, the layer is in a tape format.

One of the advantages of the present invention is that the magnetic coupling between the primary winding and the secondary winding is significantly improved. The magnetic coupling factor in the present invention can reach approximately 0.95.

In the present invention, the low permeability dielectric material (i.e. the thin layer) is formulated to have a higher dielectric volt/mil ratio than the traditional ferrite material (e.g. NiZn ferrite material) used to form the tape layers. Thus, another advantage of the present invention is that it allows an overall reduction in tape thickness required to meet dielectric test voltages, thereby using less overall material for each transformer.

A third advantage of the present invention is the lower cost of manufacture. A screen-printing process is much faster than a process of forming apertures in volume. Screens are also generally much lower cost than tooling to make apertures. In addition, tooling size and speed limit how small apertures can practically be in tape layers, whereas screens can be made inexpensively with fine details. Thinner ferrite tape layers also reduce the overall transformer height and/or weight.

The present invention also provides a method for constructing a multi-layer transformer comprising the steps of preparing a magnetic material in a multi-layer tape format, disposing a conductive winding on at least one layer of the multi-layer tape format, preparing a plurality of vias in the layers for selectively connecting the conductive windings, and disposing a non-magnetic material proximate at least one of the conductive windings.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

The present invention provides a method and apparatus of providing a multi-layer transformer with an improved magnetic coupling without affecting its electrical isolation characteristics.

The present invention provides a layer of low permeability dielectric material, thinner than but mechanically and chemically compatible with the higher permeability tape. The thin layers can be disposed on top of, on bottom of, or in between the conductive windings. The thin layers create areas of different permeability within the structure. The dielectric material in the thin layer also chemically interacts with the ferrite tape during sintering to selectively lower the ferrite permeability in the screened areas. The low permeability dielectric material forms high reluctance paths for the magnetic flux between the windings, thus encouraging the magnetic flux formation in the desired magnetic core volume rather than taking short cuts between windings. Thus, more flux linkages are formed between all primary and secondary windings thereby significantly improving the magnetic coupling factor.

Figure 3:
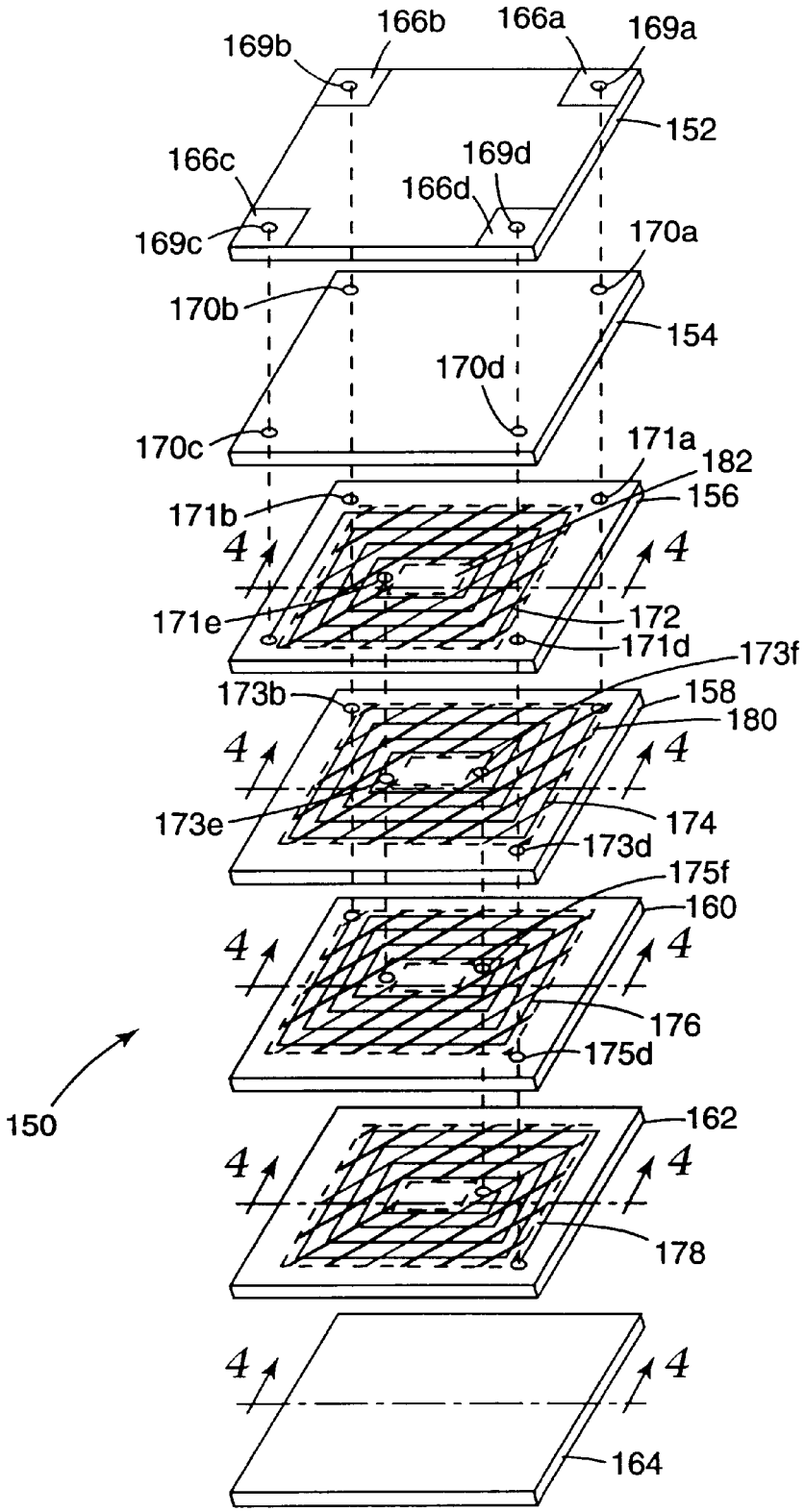
FIG. 3 illustrates an exploded view of a multi-layer transformer in accordance with one embodiment of the present invention.
Figure 4:
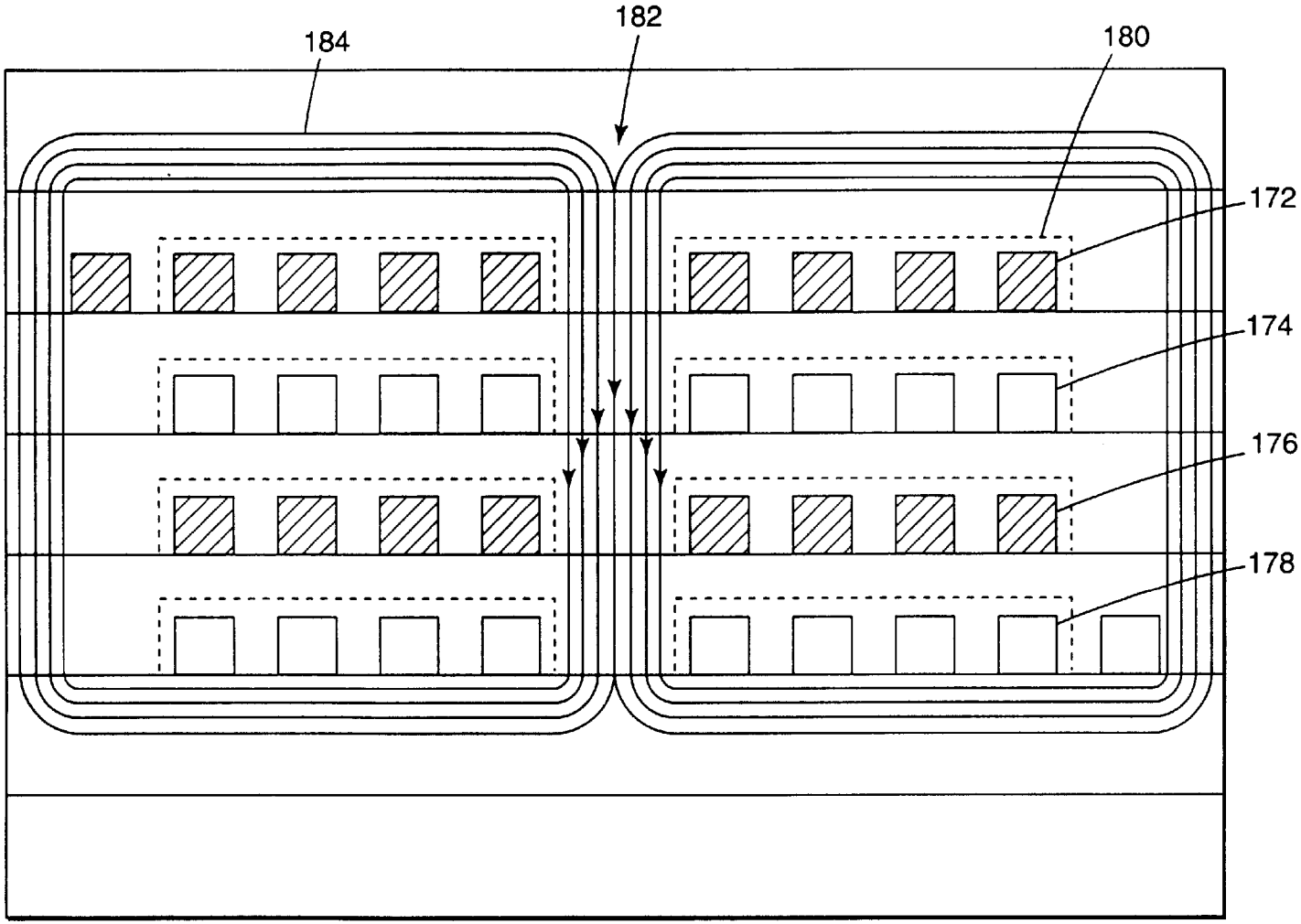
FIG. 4 illustrates a cross-sectional view of the multi-layer transformer along line 4—4 in FIG. 3.
Figure 5:
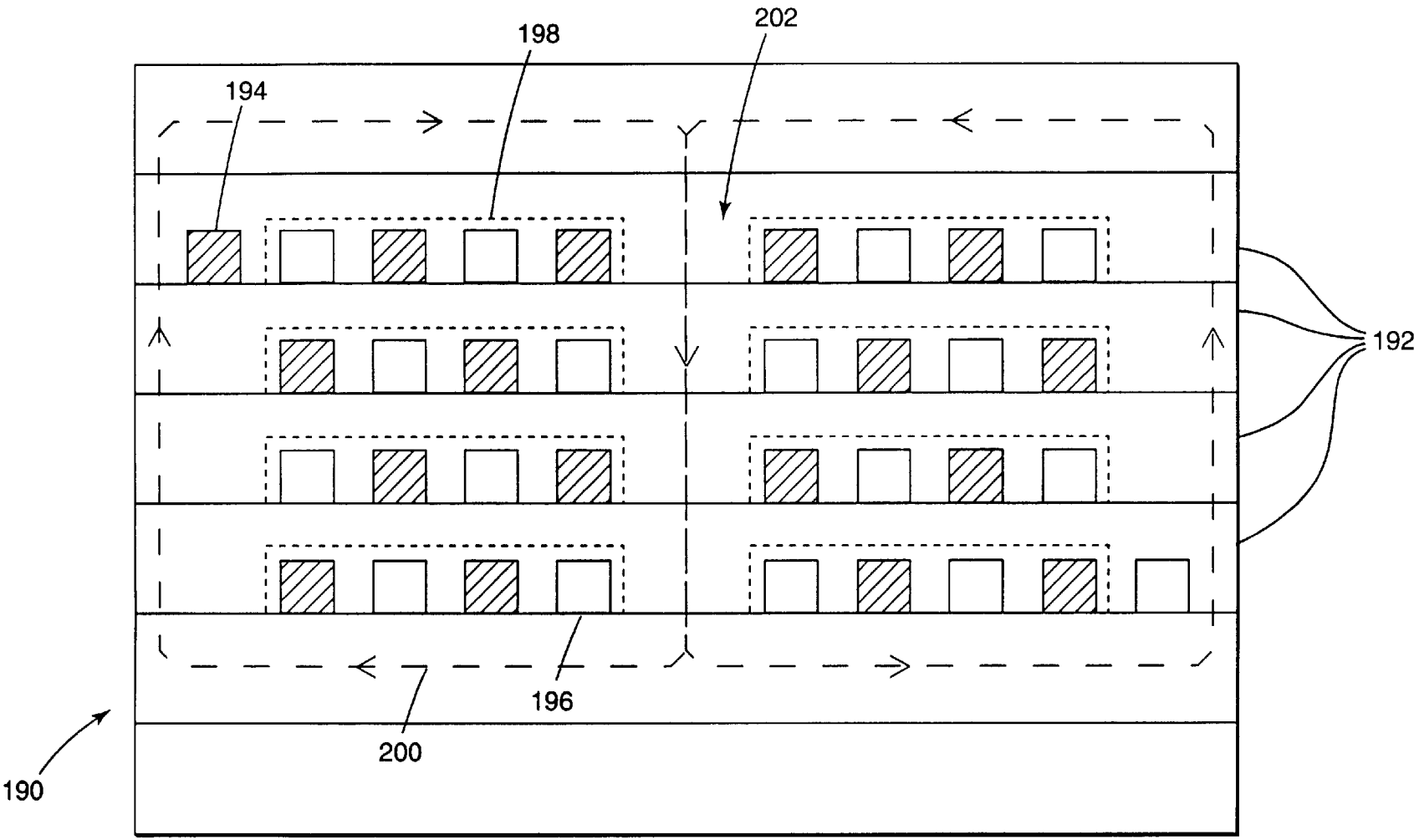
FIG. 5 illustrates a cross-sectional view of a multi-layer transformer in accordance with another embodiment of the present invention.

In preferred embodiments shown in FIGS. 3–5, a transformer with a multi-layer tape structure is shown. The transformer has tapes stacked together with windings disposed on at least some of the tapes. The windings are connected between the tapes through interconnecting vias. The transformer further includes a thin layer screen-printed or pasted onto at least some of the windings. The thin layer is made of a lower permeability dielectric material than that of the tapes so as to form high reluctance paths for magnetic flux between the windings in adjacent tapes. Thus, the flux linkage between the primary and secondary windings is improved, and a higher magnetic coupling factor can be obtained.

In the following description of the preferred embodiments, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1:
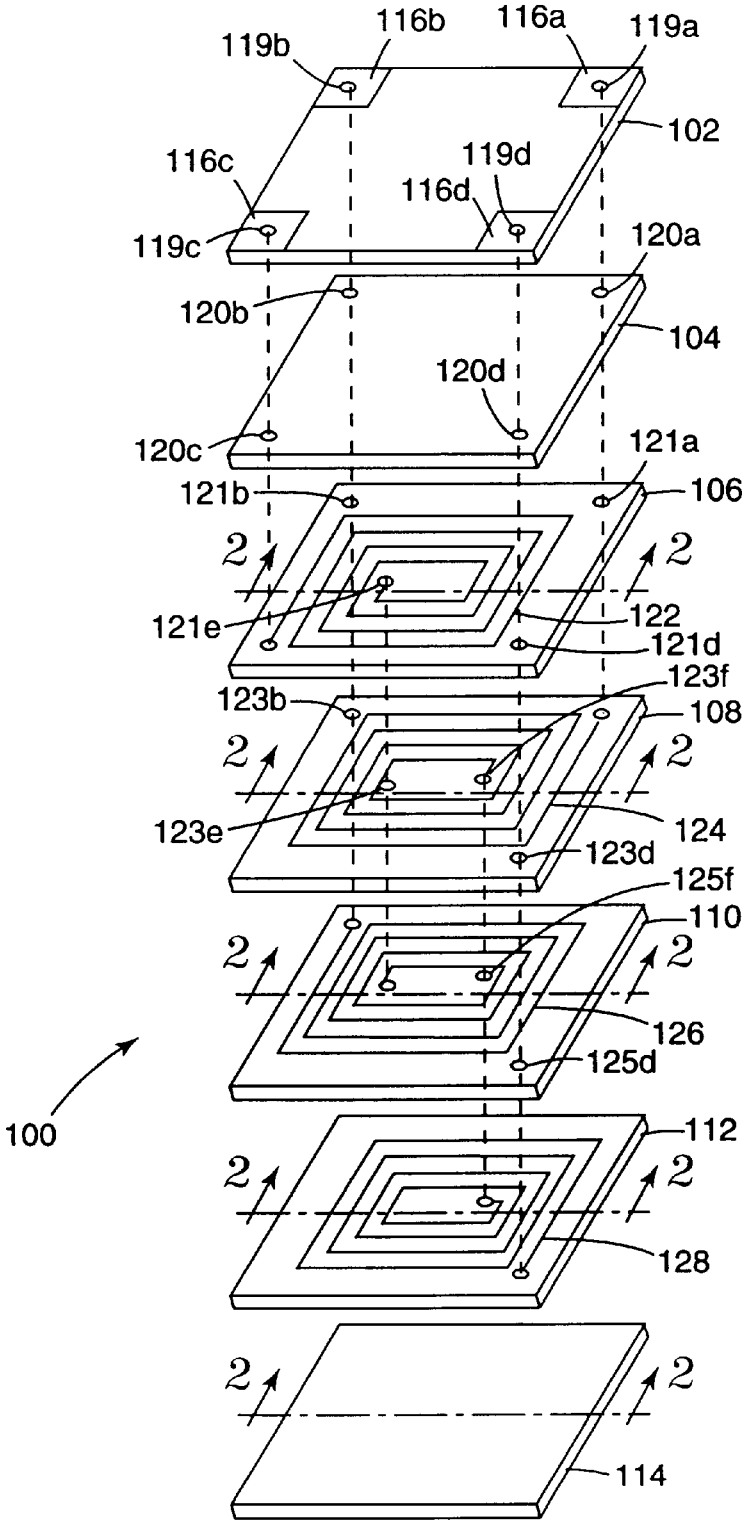
FIG. 1 illustrates an exploded view of a conventional multi-layer transformer.

In FIG. 1, a conventional multi-layer transformer 100 is formed by an end cap (top layer) 102, a layer 104, primary winding layers 106, 110 having primary windings 122 and 126, respectively, secondary winding layers 108, 112 having secondary windings 124 and 128, respectively, a bottom cap (bottom layer) 114, and conductive vias 119*a*, 119*b*, 119*c*, 119*d*, 120*a*, 120*b*, 120*c*, 120*d*, 121*a*, 121*b*, 121*d*, 121*e*, 123*b*, 123*d*, 123*e*, 123*f*, 125*d* and 125*f*. The top layer 102 of the multi-layer transformer 100 may include four terminal pads 116*a–d* and four conducting through holes 119*a–d*. Two of the terminal pads 116*b, c* connect to a primary winding starting lead and a primary winding ending lead, respectively. The other two terminal pads 116*a, d* connect to a secondary winding starting lead and a secondary winding ending lead, respectively.

The primary winding layer 106, 110 and the secondary winding layers 108, 112 may be stacked in an interleaving relationship. The primary winding 122 is connected to the terminal pad 116*c* through vias 119*c* and 120*c* and is connected to the primary winding 126 through vias 121*e* and 123*e*. The primary winding 126 is connected to the terminal pad 116*b* through vias 123*b*, 121*b*, 120*b* and 119*b*. Similarly, the secondary winding 124 is connected to the terminal pad 116*a* through vias 119*a*, 120*a* and 121*a* and is connected to the secondary winding 128 through vias 123*f* and 125*f*. The secondary winding 128 is connected to the terminal pad 116*d* through vias 125*d*, 123*d*, 121*d*, 120*d* and 119*d*.

Figure 2:
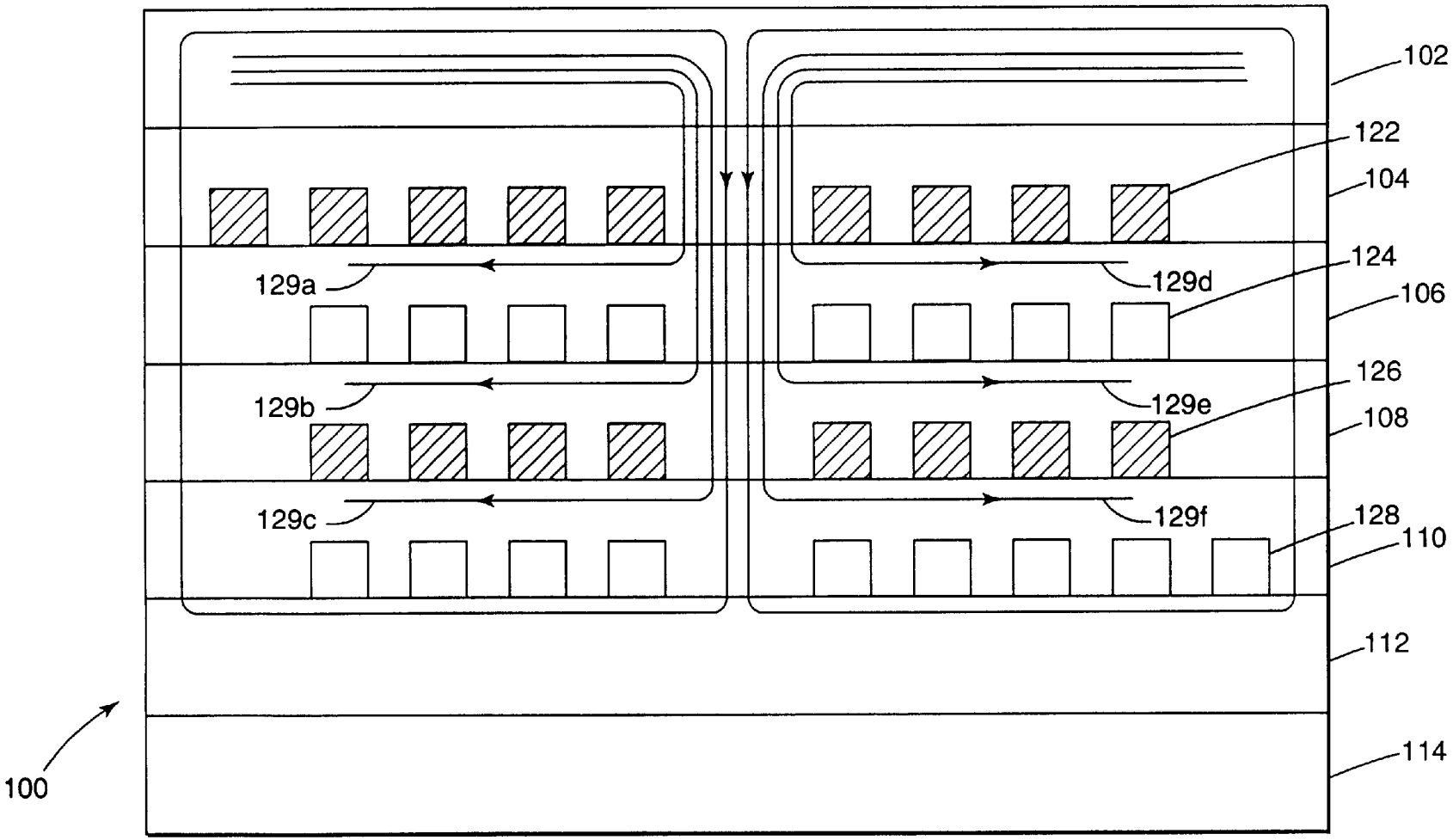
Fig. 2 (Prior Art)
FIG. 2 illustrates a cross-sectional view of the conventional multi-layer transformer along line 2—2 in FIG. 1.

FIG. 2 illustrates a cutaway cross-sectional view along line 2—2 in FIG. 1. With this structure, the shaded squares represent the turns of the primary windings 122 and 126, and the blank squares represent the turns of the secondary windings 124 and 128. The permeability of the ferrite layer is the same throughout the multi-layer transformer 100. Some magnetic flux lines 129*a–f* take short cuts between the windings. The thickness of the ferrite layers must be made enough to prevent dielectric breakdown between the windings.

In FIG. 3, a multi-layer transformer 150 in accordance with the preferred embodiment of the present invention is shown. The structure of the present invention is formed by an end cap (top layer) 152, a layer 154, primary winding layers 156, 160 having primary windings 172 and 176, respectively, secondary winding layers 158, 162 having secondary windings 174 and 178, respectively, a bottom cap (bottom layer) 164, and conductive vias 169*a*, 169*b*, 169*c*, 169*d*, 170*a*, 170*b*, 170*c*, 170*d*, 171*a*, 171*b*, 171*d*, 171*e*, 173*b*, 173*d*, 173*e*, 173*f*, 175*d* and 175*f*. The top layer 152 of the multi-layer transformer 150 may include four terminal pads 166*a–d* and four conducting through holes 169*a–d*. Two of the terminal pads 166*b, c* connect to a primary winding starting lead and a primary winding ending lead, respectively. The other two terminal pads 166*a, d* connect to a secondary winding starting lead and a secondary winding ending lead, respectively. The primary winding layers 156, 160 and the secondary winding layers 158, 162 may be stacked in an interleaving relationship. The primary winding 172 is connected to the terminal pad 166*c* through vias 169*c* and 170*c* and is connected to the primary winding 176 through vias 171*e* and 173*e*. The primary winding 176 is connected to the terminal pad 166*b* through vias 173*b*, 171*b*, 170*b* and 169*b*. Similarly, the secondary winding 174 is connected to the terminal pad 166*a* through vias 169*a*, 170*a* and 171*a* and is connected to the secondary winding 178 through vias 173*f* and 175*f*. The secondary winding 178 is connected to the terminal pad 166*d* through vias 175*d*, 173*d*, 171*d*, 170*d* and 169*d*. On the primary and secondary windings 172, 174, 176 and 178, a thin layer 180 made of low permeability dielectric material is screen-printed or pasted onto the windings (shown in FIG. 3 as the shaded areas). The thin layer can be disposed on top of the primary and secondary windings, on bottom of the primary and secondary windings, or in between the primary and secondary windings. This low permeability dielectric material is mechanically and chemically compatible with the higher permeability ferrite tape. During sintering, the low permeability dielectric material also chemically interacts with the ferrite tape to selectively lower the ferrite permeability in the screen-printed areas. Thus, the area of different permeability is obtained in each winding tape. The thin layer 180 forms high reluctance paths for the magnetic flux between the adjacent primary and secondary windings 172, 174, 176 and 178 to encourage flux formation in the desired magnetic core area 182, which is proximate the center of the tapes of the transformer 150. More flux linkages are formed between the primary turns and the secondary turns. Accordingly, the magnetic coupling factor is significantly improved. The magnetic coupling factor of the transformer 150 can reach approximately 0.95. Furthermore, the low permeability dielectric material used to form the thin layer 180 is formulated to have a higher dielectric volt/mil ratio than that of the NiZn ferrite material which may be used to form the tape layers. Thus, the tape thickness required to meet dielectric voltages can be reduced.

FIG. 4 illustrates a cutaway cross-sectional view along line 4—4 in FIG. 3. In FIG. 4, the shaded squares represent the turns of the primary windings 172 and 176, the blank squares represent the turns of the secondary windings 174 and 178, and the thin layers 180 are represented by dashed lines. Magnetic flux 184 is discouraged from leaking into the area between the windings. The magnetic flux 184 flows into a desired magnetic core area 182. It is understood that the turns of the windings may be varied according to the requirements. It is also understood that the shapes and sizes of the windings can be varied within the scope of the invention.

FIG. 5 shows another embodiment of a transformer 190 in accordance with the present invention. In FIG. 5, a primary winding and a secondary winding are deposited on each of the winding layers 192. As shown in FIG. 5, the shaded squares 194 represent the turns of the primary windings, and the blank squares 196 represent the turns of the secondary windings. The areas surrounded by dashed lines 198 are thin layers made of low permeability dielectric material. Magnetic flux 200 (simplified by one flux line) is forced into a desired magnetic core area 202. Magnetic flux 200 is discouraged from leaking into the area between the windings. The transformer 190 has improved the magnetic coupling and dielectric breakdown voltage between the windings.

When constructing the multi-layer transformers, such as 150 as shown in FIGS. 3 and 4, a magnetic material is first prepared in a multi-layer tape format. Conductive windings are printed on some of the tapes. Conductive vias are made for interconnecting the primary windings and the secondary windings between the tapes. A thin layer of low permeability dielectric material is screen-printed or pasted onto at least one of the tapes with conductive windings. With heat and pressure, the tapes with an appropriate alignment are joined together to form a multi-layer transformer.

The term non-magnetic material as used herein refers to a material whose magnetic permeability is low compared to that of the magnetic material used in the component.

In the above transformers, the magnetic coupling factor can reach approximately 0.95. It is appreciated that the magnetic coupling may be further improved depending on the desired specifications of the materials within the scope of the invention.

The top layer and subsequent layers of a transformer may be made of a ferrite material in tape format. For example, the tapes can be Low-Temperature-Cofired-Ceramic (LTCC) tapes or High-Temperature-Cofired-Ceramic (HTCC) tapes.

It is appreciated that a multitude of transformers may be manufactured simultaneously. Mass producing of the transformers in large quantities may be readily implemented by forming a large array of vias, conductive windings, and thin low-permeability layers on the sheets of magnetic material, such as ferrite material. Individual transformers can be singulated either before or after firing.

It is also appreciated that those skilled in the art would recognize many modifications that can be made to this process and configuration without departing from the spirit of the present invention. For example, the thin low-permeability layer may be disposed on each of the windings.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A transformer having a multi-layer tape structure, comprising:

a plurality of tapes being stacked one over the other having a magnetic core area proximate a center of the tapes of the transformer, the tapes directing a first magnetic flux through the magnetic core area;

a primary winding disposed on at least one of the tapes;

a secondary winding disposed on at least one of the tapes, and a second part of the magnetic flux leaking through between the primary winding and the secondary winding;

a first plurality of interconnecting vias connecting the primary winding between the tapes, and a second plurality of interconnecting vias connecting the secondary winding between the tapes; and a dielectric layer of a lower permeability in comparison to that of the tapes, the dielectric layer being disposed proximate at least one of the primary and secondary windings between the tapes to direct the second part of the magnetic flux between the windings to the magnetic core area.

2. The transformer according to claim 1, wherein the primary winding and the secondary winding are disposed in an interleaved relationship on the tapes.

3. The transformer according to claim 1, wherein the primary winding and the secondary winding are disposed on adjacent tapes.

4. The transformer according to claim 1, wherein the primary winding and the secondary winding are disposed on a same tape.

5. The transformer according to claim 1, wherein the layer is mechanically and chemically compatible with the tapes.

6. The transformer according to claim 1, wherein the layer is screen printed onto the primary and secondary windings.

7. The transformer according to claim 1, wherein the layer is pasted onto the primary and secondary windings.

8. The transformer according to claim 1, wherein the layer is in a tape format.

9. The transformer according to claim 1, wherein the layer is disposed on top of at least one of the primary and secondary windings between the tapes.

10. The transformer according to claim 1, wherein the layer is disposed on bottom of at least one of the primary and secondary windings between the tapes.

11. The transformer according to claim 1, wherein the layer is disposed in between at least one of the primary and secondary windings between the tapes.

12. A transformer having a multi-layer tape structure, comprising:

a magnetic material in a multi-layer tape format, the magnetic material directing a first magnetic flux through a magnetic core area;

a conductive winding disposed on at least two layers of the multi-layer tape format, and a second part of the magnetic flux leaking through between the conductive windings;

a plurality of interconnecting vias disposed in the layers to connect the conductive windings between the layers; and a non-magnetic material disposed on at least one of the conductive windings, the non-magnetic material redirecting the second part of the magnetic flux between the conductive windings to the magnetic core area.

13. The transformer according to claim 12, wherein the conductive windings are disposed in an interleaved relationship on the layers of the multi-layer tape format.

14. The transformer according to claim 12, wherein the conductive windings are disposed on adjacent tapes.

15. The transformer according to claim 15, wherein the conductive windings are disposed on a same tape.

16. The transformer according to claim 12, wherein the non-magnetic material is mechanically and chemically compatible with the multi-layer tape format.

17. The transformer according to claim 12, wherein the non-magnetic material is screen-printed onto the conductive windings.

18. The transformer according to claim 12, wherein the non-magnetic material is pasted onto the conductive windings.

19. The transformer according to claim 12, wherein the non-magnetic material is in a tape format.

20. A method for constructing a multi-layer transformer, comprising:

preparing a magnetic material in a multi-layer tape format, the magnetic material directing a first magnetic flux through a magnetic core area;

disposing a conductive winding on at least two layers of the multi-layer tape format, and a second part of the magnetic flux leaking through between the conductive windings;

preparing a plurality of vias in the layers for selectively connecting the conductive windings; and disposing a non-magnetic material proximate at least one of the conductive windings, the non-magnetic material redirecting the second part of the magnetic flux between the conductive windings to the magnetic core area.

21. The method of claim 20, wherein one of the conductive windings is a primary winding, one of the conductive windings is a secondary winding, the primary and secondary windings are disposed in an interleaved relationship on the layers.

22. The method of claim 20, wherein one of the conductive windings is a primary winding, one of the conductive windings is a secondary winding, the primary and secondary windings are disposed on a same layer.

23. The method of claim 20, wherein the non-magnetic material is in a tape format.

* * * * *